US005335977A

United States Patent [19]

Morrell et al.

[11] Patent Number: 5,335,977

[45] Date of Patent: Aug. 9, 1994

[54] DOUBLE ACTING BIT HOLDER

[75] Inventors: Roger J. Morrell, Blommington; David A. Larson, Minneapolis; Peter L. Ruzzi, Eagan, all of Minn.

[73] Assignee: The United States of America as represented by the Secretary of the Interior, Washington, D.C.

[21] Appl. No.: 67,181

[22] Filed: May 26, 1993

[51] Int. Cl.[5] ..... E21C 25/10

[52] U.S. Cl. ..... 299/92; 299/85

[58] Field of Search ..... 299/85, 86, 91, 92; 37/458, 459

[56] References Cited

U.S. PATENT DOCUMENTS

| | | | |
|---|---|---|---|
| 3,697,137 | 10/1972 | Krekeler | 299/92 X |
| 3,945,681 | 3/1976 | White | 299/91 X |
| 5,018,793 | 5/1991 | Den Besten | 299/92 X |

FOREIGN PATENT DOCUMENTS

| | | | |
|---|---|---|---|
| 445434 | 6/1927 | Fed. Rep. of Germany | 299/92 |

*Primary Examiner*—David J. Bagnell

*Attorney, Agent, or Firm*—E. Philip Koltos

[57] ABSTRACT

A double acting bit holder that permits bits held in it to be resharpened during cutting action to increase energy efficiency by reducing the amount of small chips produced. The holder consist of: a stationary base portion capable of being fixed to a cutter head of an excavation machine and having an integral extension therefrom with a bore hole therethrough to accommodate a pin shaft; a movable portion coextensive with the base having a pin shaft integrally extending therefrom that is insertable in the bore hole of the base member to permit the moveable portion to rotate about the axis of the pin shaft; a recess in the movable portion of the holder to accommodate a shank of a bit; and a biased spring disposed in adjoining openings in the base and moveable portions of the holder to permit the moveable portion to pivot around the pin shaft during cutting action of a bit fixed in a turret to allow front, mid and back positions of the bit during cutting to lessen creation of small chip amounts and resharpen the bit during excavation use.

9 Claims, 2 Drawing Sheets

DOUBLE ACTING BIT HOLDER

BACKGROUND OF THE INVENTION

1. Field of the Invention

The present invention relates generally to excavation tools for the mining industry, where fragmenting rock, coal and other minerals is accomplished by the use of drag bits. More particularly, the present invention relates to utilizing a double acting bit holder in lieu of known drag bit holders to improve the cutting action of the bit while providing a means for resharpening and maintaining the bit in a sharp condition during excavation use.

2. Description of the Prior Art

A large number of excavation machines used in the mining and construction industries are equipped with drag bits, and these machines include continuous miners, boring machines, road headers, saws, drills and trenchers. The cutting surfaces or heads of these machines may be equipped with a few to more than 100 individual drag bits, each of which is held in place by a bit holder or bit block. The types of bit holders will depend on the types of bits used, and the bits may be of a conical type, cutter type, or concave type. While there are different holders for different types of bits, each holder has a recess for the shank of the bit and some kind of mechanism to secure the bit to the holder.

The bit holders function to secure the replaceable drag bits securely to the cutting surface of the excavator, and the holders are simple devices with no moving parts that hold the bit secure in the proper cutting position. The cutting action of these drag cutters is a simple plowing motion that enables the bit to stay in contact with the material being cut. Nevertheless, the continuous plowing action produces a variety of small and large chips, and forms a zone of crushed material under the bit, and the materials under the crushed zone and the amount of small chips are indicative of inefficient and costly cutting that induces excessive bit wear and bit heating. The inefficient cutting motion is the first major disadvantage of conventional bit holders, and as the individual drag bits become worn out, they are replaced because there is no means for resharpening the bits during their cutting life. Therefore, as the bit becomes worn, the production rate falls off while the cutting forces, dust generation and damaging machine vibrations increase, and this process continues up to the end of the bits lives, where the bits may require up to five times the force and energy that would normally be required for new sharp bits.

Accordingly, the second major disadvantage of conventional bit holders is their inability to resharpen or keep the bit sharp over the course of its cutting life activity.

An exception to conventional bit holders with no moving parts are the pin mounted embodiments of U.S. Pat. No. 3,697,137 which allows rotation of the bit about a pin. However, these holders do not have a front sharpening position as defined by the front stop and thus cannot maintain or resharpen bits during cutting and they do not have the ability to provide an impact force to the bit in the direction of the cut to aid in the cutting process.

SUMMARY OF THE INVENTION

One object of the present invention is to provide a bit holder characterized by more efficient cutting motion than conventional bit holders in order to substantially reduce or eliminate the crushed zone and the large number of small chips that are inefficiently and expensively produced as a result of expensive bit wear and bit heating using conventional bit holders.

Another object of the invention is to provide a bit holder having the capability to resharpen the bit and keep it sharp during the cutting life of the bit, in contrast to conventional bit holders.

A yet further object of the invention is to provide a double acting bit holder characterized by efficient cutting motion that lessens the crushed zone as well as the large number of small chips which normally accompany conventional bit holder action which causes excessive bit wear and bit heating, but no resharpening or maintenance of sharpening during the cutting life of the bit holder.

Another object of the invention is to provide a bit holder having the capacity to furnish an impact to assist chip formation ahead of the bit.

These and other objects of the invention will become more apparent by reference to the drawings and detailed description.

BRIEF DESCRIPTION OF THE DRAWINGS

The accompanying drawings which are incorporated in and form a part of the specification will illustrate preferred embodiments of the present invention, and together with the description, will serve to explain the principles of the invention. In the drawings.

DETAILED DESCRIPTION OF THE PREFERRED EMBODIMENTS

In its essential characteristics, the double acting bit holder is a novel bit holder that automatically and continuously combines two separate functions. These two separate functions are a resharpening function and an improved cutting function which combines an indentation, an impact and a plowing motion. Further, the double acting bit holder may be designed for use with any type of drag cutter (point attack, cutter type and concave type) and can be mounted on any type of excavation machine.

Figure 1:
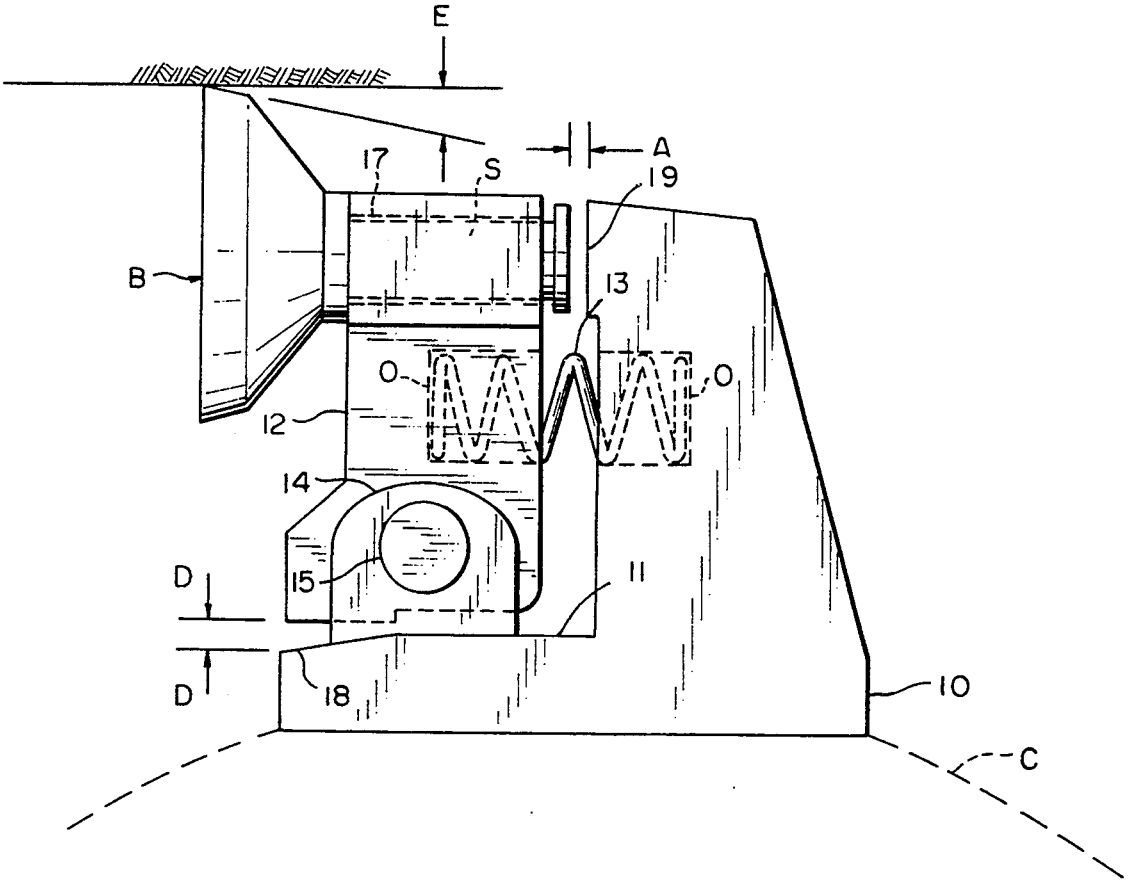
FIG. 1 depicts a side view of a double acting bit holder.
Figure 2:
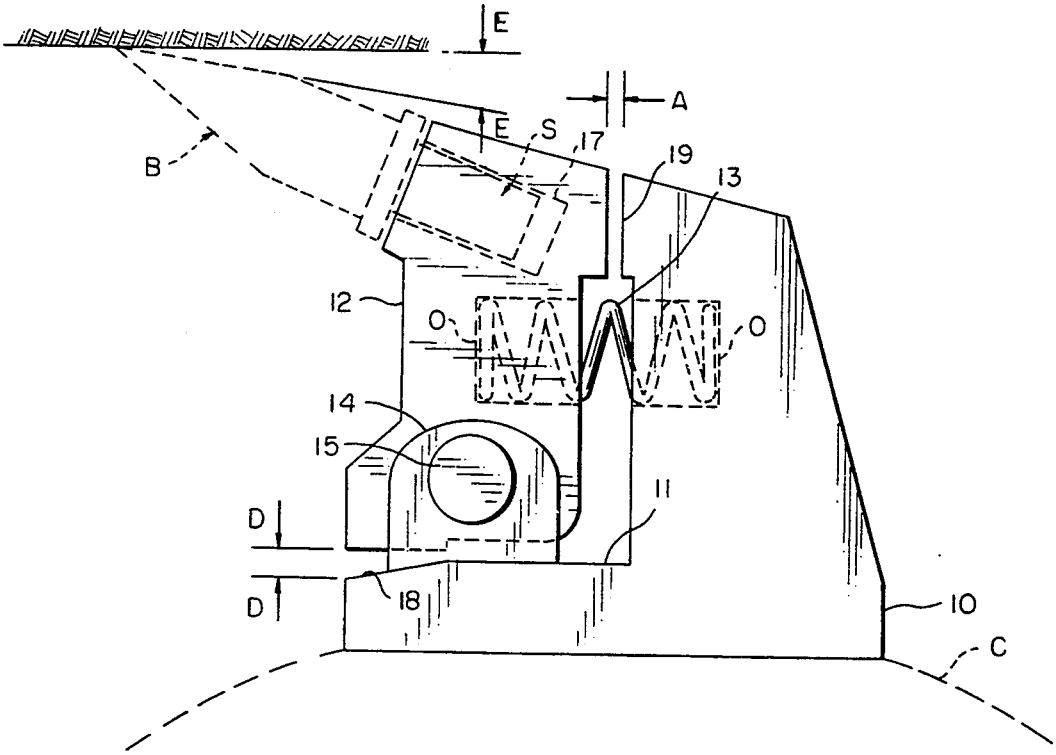
FIG. 2 is an alternate embodiment of the double acting bit holder of the invention.

Reference is now made to FIGS. 1 and 2, which show respectively, the double acting bit holder from a sectional side view and an alternate embodiment from a sectional side view.

In FIG. 1 and 2, there is depicted, a cutter head C on which a bit holder 10 is positioned. The double acting bit holder comprises a stationary base 11 with front stop 18 and back stop 19, a moveable part 12, and a coil spring 13 that fits into adjoining openings O disposed or bored in the stationary base and the movable part. The stationary base has an integral extension 14 having a hole through which a pin shaft 15 extends in order to pivotally connect the stationary base portion with the movable portion of the holder. The stationary base is rigidly attached to the cutter head section of the excavation machine by bolting or welding, and the movable part of the holder has a recess 17 which may be circular or rectangular, to hold shank portion S of bit B (which is not a part of the invention). In operation, the movable part of the holder carries the bit and rotates between front stop 18 and back stop 19 around the pin shaft to provide variable rotation that is limited between about 10° to about 30°. As the pin shaft holds the stationary and movable parts together while allowing the movable part to rotate, the spring or coil keeps the movable unit against the front stop 18 and returns it to this position. Arrows A show the distance to the full back impact position, while arrows D show the distance to the front sharpening position. In FIG. 1, the double acting bit holder is shown in the mid-position, and arrows E show the clearance angle between the bit in mid-position and the surface being cut.

FIG. 2 is an alternate embodiment of the double acting bit holder of the invention, where the reference numbers shown represent the same elements as those described in connection with FIG. 1. Spring 13 can be of any type (as shown by a coil spring in FIG. 1) and of any size that suits the bit and cutting conditions. Moreover, since different style bits use different shanks, the movable part that actually holds the bit will be different for each different bit type used. Also, all parts except the spring will be constructed of high quality steel which may be heat treated and case hardened. The spring can be of any type, including coil, leaf, torsional, disc or elastomer, and constructed of any suitable material.

While the cutting function and the resharpening function of the double acting bit holder of the invention will be described separately, it is emphasized that these two functions occur simultaneously, and that these two functions proceed continuously during normal excavation operations using the double acting bit holder of the invention.

CUTTING FUNCTION

Figure 3:
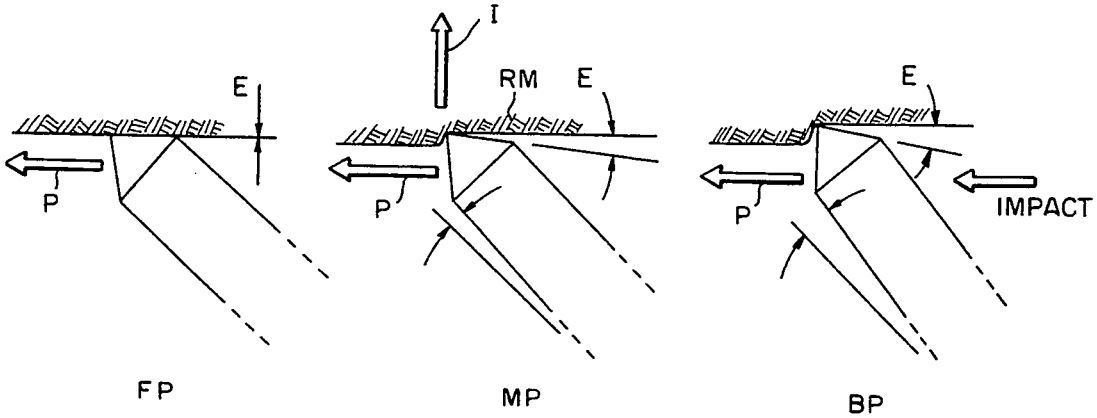
FIG. 3 shows the bit positions with the double acting bit holder in the front position, mid-position and back position.

In describing the cutting function, reference is made to FIG. 3 which depicts the various bit positions associated with installation of the bit in the double acting bit holder of the invention. The sequence of events that occurs during the cutting function combines an indenting motion (shown by arrow I) and a plowing motion (as shown by arrows P) a front position for sharpening and cutting (as shown by FP), a mid-position for cutting only (as shown by MP), and a back position for cutting only (as shown by BP) with impact.

In the front position (FP) of sharpening and cutting: the direction of cut is forward or reverse; the cutting action is shallow plowing; the depth of cut is shallow; and the clearance angle is zero or negative.

As to the mid-position (MP) of cutting only: the direction of cut is forward only; the cutting action is plowing and indention; the depth of cut is variable; and the clearance angle is variable positive.

In the back position (BP) of cutting only: the direction of cut is forward only; the cutting action is deep plowing; the depth of cut is maximum; and the clearance angle is maximum positive and an impact force is applied to the bit.

Before the bit enters the rock, the bit is in the forward position (FP), and is held in that position by the preset spring force. The bit's forward position is limited by the contact between the front portion of the movable and stationary parts. As the bit begins to cut into the material, the cutting force begins to rise, and when this cutting force is large enough, it overcomes the spring force and the bit is rotated backwards or clockwise, and this rotation effectively pushes or indents the tip of the bit deeper into the rock mass (RM). The indention and plowing action continues until conditions are favorable to form a chip ahead of the bit tip as shown in position MP (this may happen when the bit is partially backed or when it is fully backed). The back position is limited by the contact between the back portions of the movable part 12 and the back stop 19 of the stationary parts. In the full back position, the indenting action ceases, the plowing action dominates and an impact force is applied to the bit by back stop 19. Once a chip is formed, the bit swings rapidly back to the forward position by the action of the spring, whereupon the cycle repeats. While the total amount of angular motion is variable, it will normally be between about 10°–30°, and the amount of rotation may be controlled by varying the space between the movable and stationary parts.

Referring now to FIG. 2; if the moveable part 12 and the back stop 19 of the stationary part 11 strike each other with high velocity, then in addition to the plowing force, an impact force is generated and transmitted to bit B. This impact force helps to form a chip out ahead of the bit and can be a significant aid to the cutting process. If part 12 and part 19 do not strike each other with any significant velocity, then no impact force is created but the cutting process continues as described earlier.

It is important to note that the amount of spring force developed during cutting is a function of the size of the spring used, and is therefore adjustable. The force to move the movable part 12 off front stop 18 is also variable by changing the preload of the spring. The shape of the bit tip is also a variable and may be of a chisel, curved or conical shape and made of steel, tungsten carbide or any other suitable material.

In order to illustrate the principles of the operation of the double acting bit holder of the invention, a review of the traces of the cutting forces experienced by a conventional drag bit and a drag bit mounted in the double acting bit holder of the invention is useful. A conventional drag bit has a cutting force which varies constantly during cutting, and the large variation in force peaks indicate that chips of many different sizes are being produced. Also, there is greater or lesser continuous cutting between major force peaks, such that the conventional drag bit is in constant contact with the rock, and this is the primary cause of frictional heating of the bit and the large amounts of dust and fines that are produced.

On the other hand, the trace of the cutting force for the double acting bit show fewer, but higher force peaks, and each force peak represents the formation of a major chip. Since the large chips form at, or slightly below, the maximum depth of cut, the cutter tip generally does not contact the rock between major chips. This greatly reduces frictional heating and the generation of excessive fines and energy consumption. Therefore, the energy per unit volume used to fragment rock is significantly lower with the double-acting bit and therefore reflects its more efficient cutting action.

By controlling the depth of cut, the amount of rotation of the bit, and the speed of the cutter head, the size of the chips, and the frequency of chipping can be controlled. Further, the cutting action can be controlled from shallow rapid chipping to deep, slow chipping in order to suit the material being cut and the type of excavator being used.

SHARPENING FUNCTION

The second major function of the double acting bit holder is the sharpening action. For background understanding, it should be known that the normal method of resharpening a drag cutter is to grind the negative clearance angle into a positive clearance angle. The negative clearance angle becomes apparent as the rounding off of the leading edge of the bit occurs or by the development of a wear flat on the bit tip. As an example, a sharp bit is one that has a positive clearance angle as shown by arrows E in FIG. 1.

In order to maintain a sharp condition or to resharpen a worn bit, the double acting bit holder holds the bit in a special sharpening position as defined by the front stop 18. The special sharpening position is the full forward position that presents a zero, or slightly negative clearance angle (up to about −15°) to the material being cut, as is shown in position FP in FIG. 3. As the bit moves through the material, the dragging action of the bit itself serves to grind down the back clearance angle to remove any rounding or wear flats that occurred during normal cutting. The resharpening position will remain as long as the force on the cutter is less than the preset spring force. Generally however sharpening will normally occur at the shallow beginning and end of a crescent-shaped rotary cut, or it can be achieved by purposely taking shallow cuts or by abrading the bits against an artificial grinding surface. Also, in the case of machines that are able to reverse the direction of the cutter head, running the cutter head in reverse will also produce the resharpening effect.

The effectiveness of the resharpening process will depend on the material being cut (primarily its hardness and abrasiveness), the type and material of the bit, the magnitude of spring force, and the cutting technique employed. In most cases however, bit sharpening can be accomplished automatically and continuously during normal cutting operations.

The key features of the double acting bit holder of the invention are: the novel bit holder provides an indention action, a plowing action and an impact action automatically and continuously to produce larger, more energy-efficient cuttings while reducing the plowing scraping motion between major chips; the bit holder automatically holds the bit in a resharpening position during shallow cutting or in the reverse non-cutting direction; the bit holder has a movable portion that holds the bit and rotates around a pin shaft; and the bit holder comprises a spring that aids both in the chipping process and continuously restores the bit to the resharpening position. As a result of these key innovative features of the double acting bit holder of the invention, longer bit life is obtained, the bit is maintained in a sharp condition during the normal cutting process, the bit is resharpened without the necessity of removing it from the cutter head, the cutting process achieves a more energy-efficient fragmentation, there is a reduction in the amount of dust generated, and the ignition hazard from methane gas production is reduced.

While the foregoing description and illustration of the present invention have been particularly shown in detail with reference to preferred embodiments, it should be understood by those skilled in the art that the foregoing are exemplary only, and that equivalent changes may be employed without departing from the spirit and scope of the invention. The embodiments of the invention in which an exclusive property right or privilege are claimed as follows:

What is claimed is:

1. A double acting bit holder that permits bits held therein to be resharpened during cutting action and reduce dust generation and energy consumption by eliminating the amount of small chips produced comprising:

a stationary base portion capable of being fixed to a cutter head of an excavation machine and having an integral extension therefrom with a bore hole therethrough to accommodate a pin shaft;

a front stop in said base portion to hold the bit in the resharpening position;

a back stop in said base portion to provide an impact force to the bit when in the full back position;

a movable portion coextensive with said base portion having a pin shaft integrally extending therefrom that is insertable in said bore hole of said base member to permit said moveable portion to rotate about the axis of said pin shaft;

a recess in said movable portion of said holder to accommodate the shank of a bit; and a biased spring disposed in adjoining openings in said base and moveable portions of said holder to permit said moveable portion to pivot around said pin shaft during cutting action of a bit fixed in said recess to allow front, mid and back positions of said bit during cutting to lessen creation of small chips, provide an impact force to the bit, and resharpen said bit during cutting action or by abrading against an artificial surface for the cutting life of said bit.

2. The double acting bit holder of claim 1, wherein said moveable portion having an integral pin shaft has a rectangular cut-away portion along a length between the front and back position stops.

3. The double acting bit holder of claim 2, wherein said spring is selected from a coil, leaf, disc, torsion or elastomer.

4. The double acting bit holder of claim 3, wherein a distance between the front stop of said moveable portion and the back stop of said stationary portion and the position of the pin shaft relative to the tip of the bit is such as to permit rotation around said pin shaft between about 10° to about 30° for said moveable member.

5. The double acting bit holder of claim 1, mounted on an excavation machine having a point attack drag cutter.

6. The double acting bit holder of claim 1, mounted on an excavation machine having a cutter type drag cutter.

7. The double acting bit holder of claim 1, mounted on an excavation machine having a concave drag cutter.

8. The double acting bit holder of claim 1, wherein said recess for holding a bit shank is circular.

9. The double acting bit holder of claim 1, wherein said recess for holding a bit shank is rectangular.

* * * * *